US007530522B2

(12) United States Patent
Popp

(10) Patent No.: US 7,530,522 B2
(45) Date of Patent: May 12, 2009

(54) VEHICLE MOUNTABLE FENCE SPOOLING DEVICE

(76) Inventor: G. Warren Popp, 5441 GA Hwy 219, Fortson, GA (US) 31808

( * ) Notice: Subject to any disclaimer, the term of this patent is extended or adjusted under 35 U.S.C. 154(b) by 0 days.

(21) Appl. No.: 11/374,272

(22) Filed: Mar. 13, 2006

(65) Prior Publication Data

US 2007/0210200 A1 Sep. 13, 2007

(51) Int. Cl.
*B65H 16/02* (2006.01)

(52) U.S. Cl. ..... 242/557; 242/396.5

(58) Field of Classification Search ..... 242/557, 242/598.5, 403, 396.5, 397, 125.2, 580; 256/37
See application file for complete search history.

(56) References Cited

U.S. PATENT DOCUMENTS

| | | | | |
|---|---|---|---|---|
| 1,353,304 | A | | 9/1920 | Ahistrom |
| 2,859,944 | A | | 11/1958 | Cisney |
| 3,048,348 | A | | 8/1962 | Griffin |
| 3,243,141 | A | | 3/1966 | Cook |
| 3,570,731 | A | * | 3/1971 | Waltz ..... 242/557 |
| 3,579,731 | A | | 5/1971 | Waltz |
| 4,854,521 | A | | 8/1989 | Farnsworth |
| 4,930,718 | A | | 6/1990 | Lancour et al. |
| 5,163,634 | A | | 11/1992 | Moon et al. |
| 5,476,234 | A | * | 12/1995 | St. Pierre ..... 242/557 |
| 5,582,216 | A | | 12/1996 | Smith et al. |
| 5,632,470 | A | | 5/1997 | Leland |
| 5,806,779 | A | | 9/1998 | Crum |
| 6,042,046 | A | * | 3/2000 | Beyer, Sr. ..... 242/557 |
| 6,360,984 | B1 | | 3/2002 | England |
| 6,543,713 | B1 | * | 4/2003 | Frolander et al. ..... 242/557 |
| 2004/0065768 | A1 | | 4/2004 | Parker |
| 2005/0133776 | A1 | | 6/2005 | Capps |

* cited by examiner

*Primary Examiner*—William A Rivera

(57) ABSTRACT

A fence spooling device is provided that may be mounted to a motor vehicle. The device includes a frame and a cradle that is connected to the frame. The cradle is rotatable about a pre-determined axis. The cradle is configured to receive and hold one or more spools of fence wire. A gripper assembly is provided to allow an operator to selectively apply resistance to the distribution of fence from a spool held in the cradle to aid in bringing fence wire to a desired level of tautness.

13 Claims, 20 Drawing Sheets

VEHICLE MOUNTABLE FENCE SPOOLING DEVICE

CLAIM OF PRIORITY

No claim of priority to a prior application is made.

TECHNICAL FIELD

The present invention relates to a fence construction device, and, more particularly to a motor vehicle based fence spooling device for distributing fence wire from one or more spools of wire. The invention is also directed to providing a spooling device capable of tensioning fencing wire distributed along a predetermined boundary.

SUMMARY OF THE INVENTION

The present invention provides a motor vehicle based fence spooling device that allows for easy loading/unloading of fence spools and tensioning of distributed fence materials prior to attaching the fence materials to a predetermined fence support structure. In one embodiment, the device includes a frame and a cradle configured to receive a spool of fence wire. The cradle is rotatable about a predetermined axis relative to the frame.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BACKGROUND

Construction and repair of fences is time consuming and requires substantial man power to lift, load, distribute and attach fence material along a pre-determined fence support structure. In constructing a typical wire fence, fence wire is spooled off of one or more spools containing fence wire along a perimeter defined by one or more fence posts. The fences wire is a then pulled to make it taut and attached to the fence posts. Fence wire is often made of aluminum, steel, stainless steel or other materials. The spools used to contain fence wire until it is distributed and placed on fence posts can be large and/or heavy.

Devices have been proposed that allow for the distribution of fence wire from one or more spools of fence wire so that it may be attached to a fence support structure, such as, for example, one or more fence post seated and extending upward from the ground. These known devices typically require substantial maneuvering and manual lifting to load the device with a spool of fence wire. This labor intensive and subjects personnel to risk of injury or fatigue while loading/unloading spools of wire from the fencing device.

Those known devices that are mountable to a motor vehicle often provide no means for tensioning fence wire prior to it being attached to a fence support structure/fence post. Where provisions are provided for tensioning fence wire, it is necessary for another person to be available to assist the motor vehicle operator, or it requires that the motor vehicle operator get down off of the motor vehicle in order to attend to tensioning of the distributed fence wire. This is time consuming and labor intensive.

In view of the above it is clear that there exists an unaddressed need in the industry to address the aforementioned shortcoming, deficiencies and inadequacies. The present invention is directed to overcoming the aforementioned shortcoming, deficiencies and inadequacies of the prior art.

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1A:
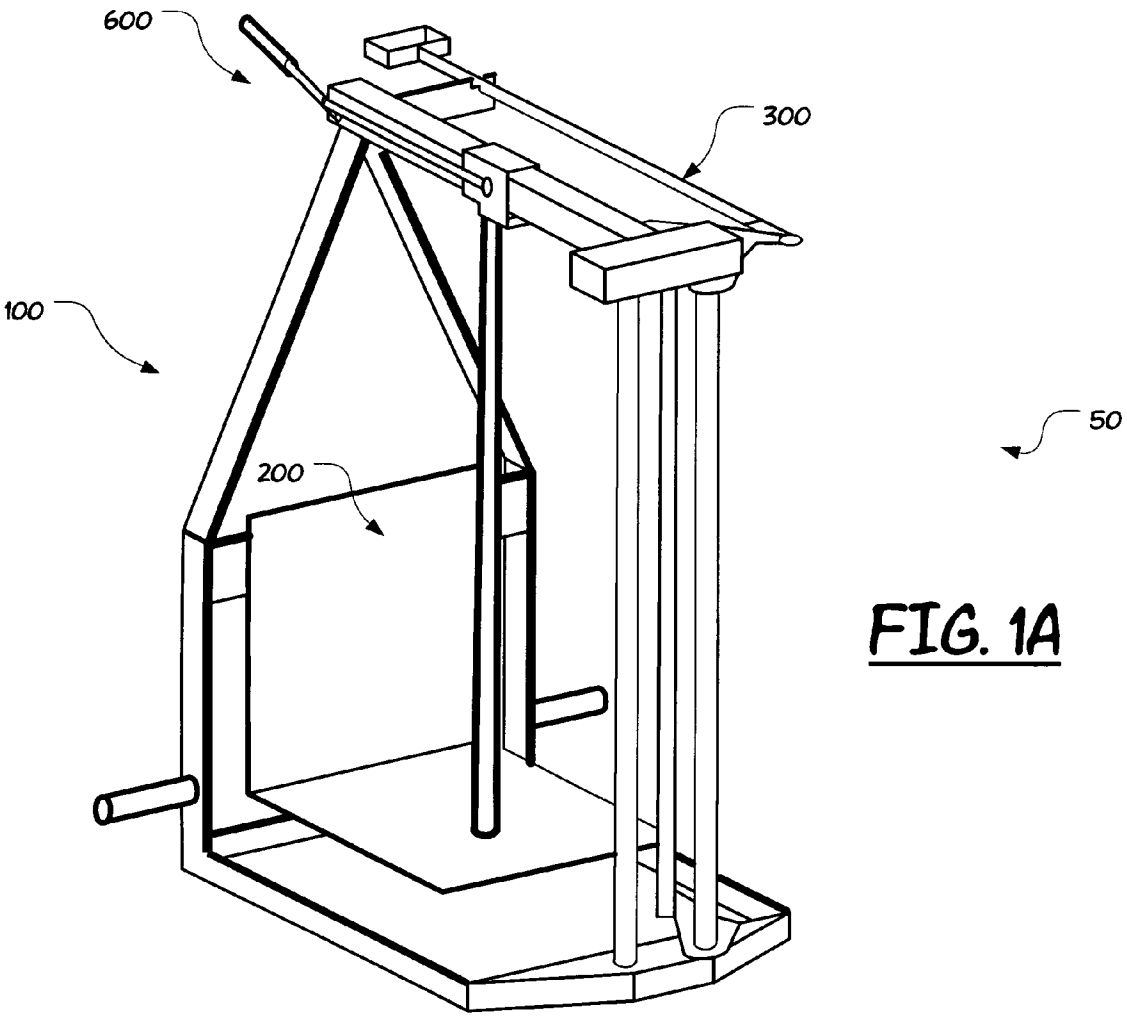
FIG. 1A-FIG. 1C are diagrams depicting one embodiment of a fence spooling device 50 according to the present invention.

FIG. 1A is a diagram illustrating one embodiment of a fence spooling device 50 according to the present invention. The fence spooling device 50 includes a frame 100, a cradle 200, a gripper assembly 300 and a cradle lock assembly 600. The cradle 200 is configured to attach to the frame 100 in a manner that allows it to be rotated to the left or right of the fence spooling device 50.

Figure 1B:
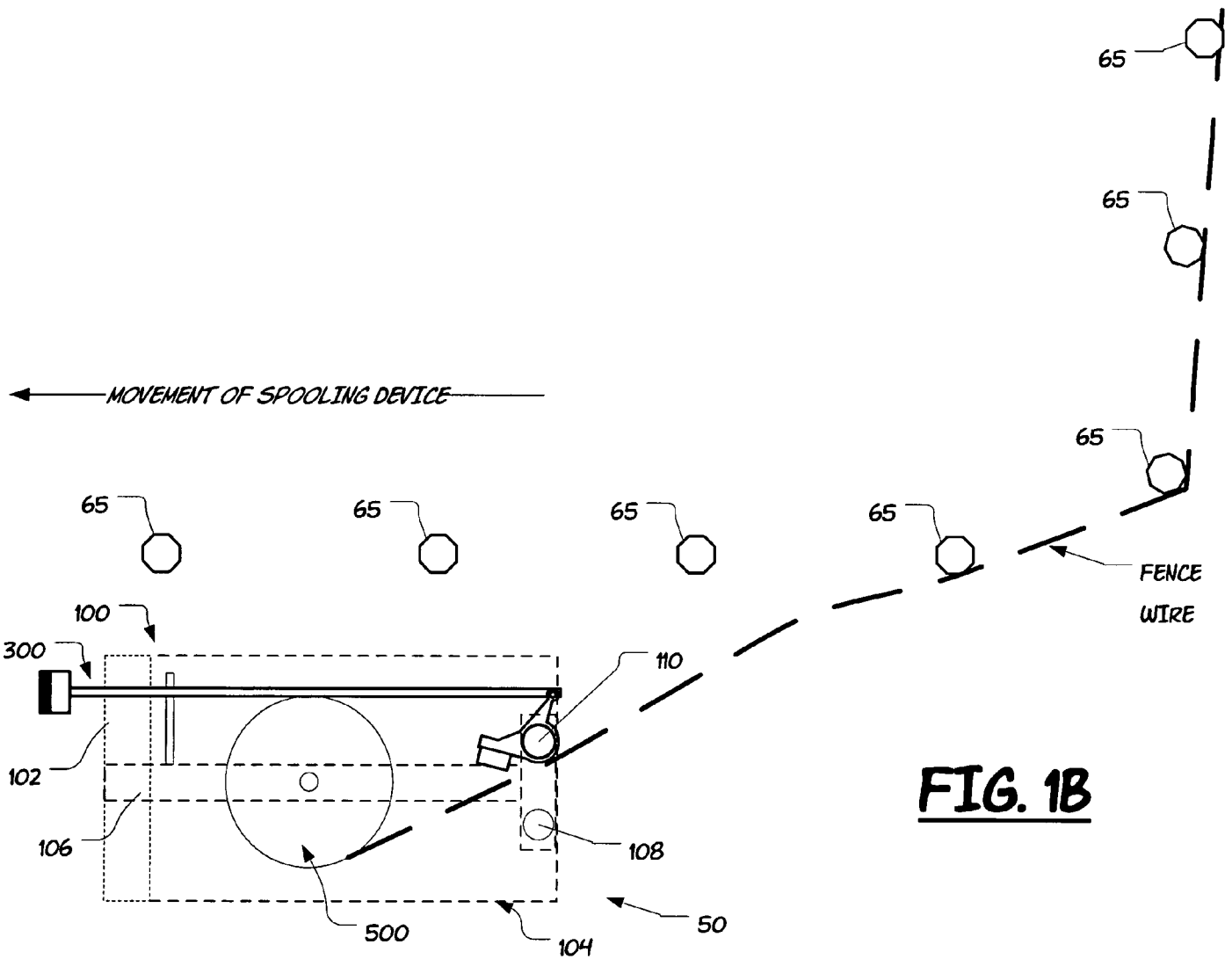

With reference to FIG. 1B, the fence spooling device 50 is configured to distribute fence wire along a perimeter defined by a series of fence post 65 (fence support structure). In practice, as the fence wire is distributed long the perimeter, it will be attached to the fence posts 65 so as to enclose the area bounded by the fence posts 65.

Figure 1C:
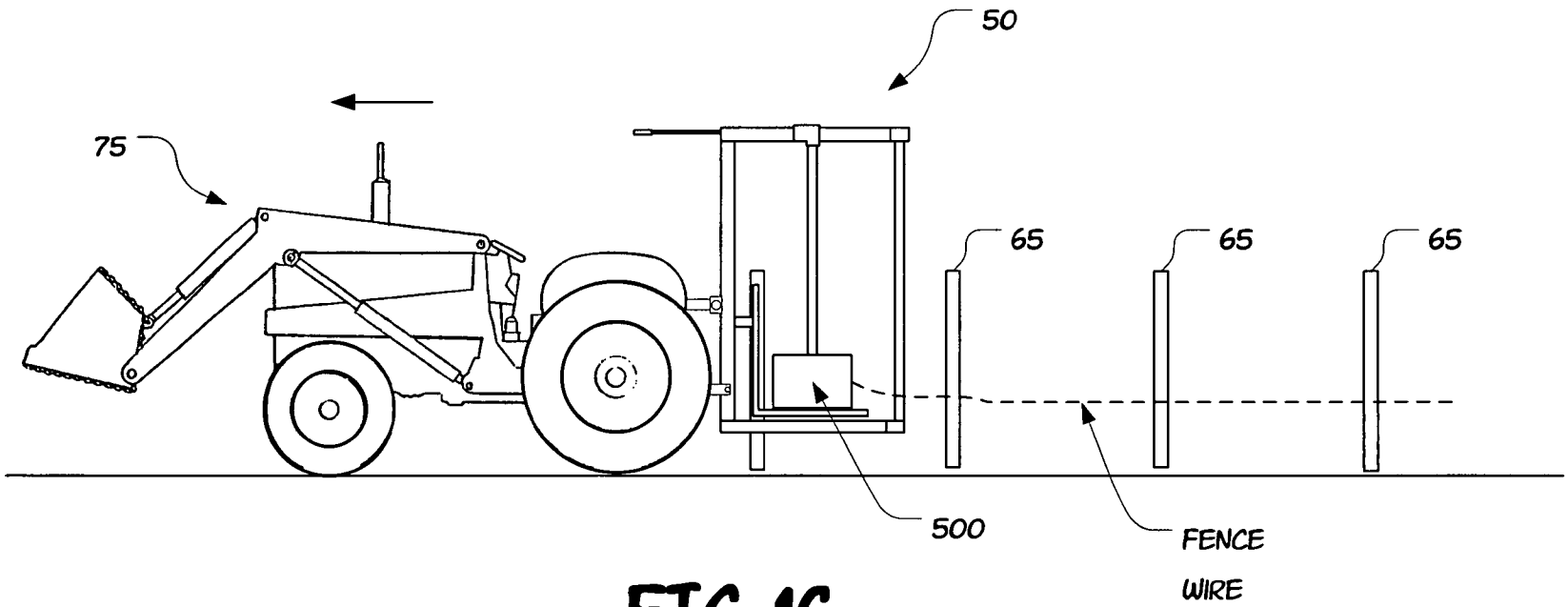

FIG. 1C is a further diagram showing the spooling device 50 attached to a motor vehicle 75. The fence wire is spooled off of the spool 500 and distributed along a perimeter defined by the fence posts 65. As a part of the fence construction process, the fence wire, once spooled off the spool 500, is attached to the fence posts 65.

Figure 2:
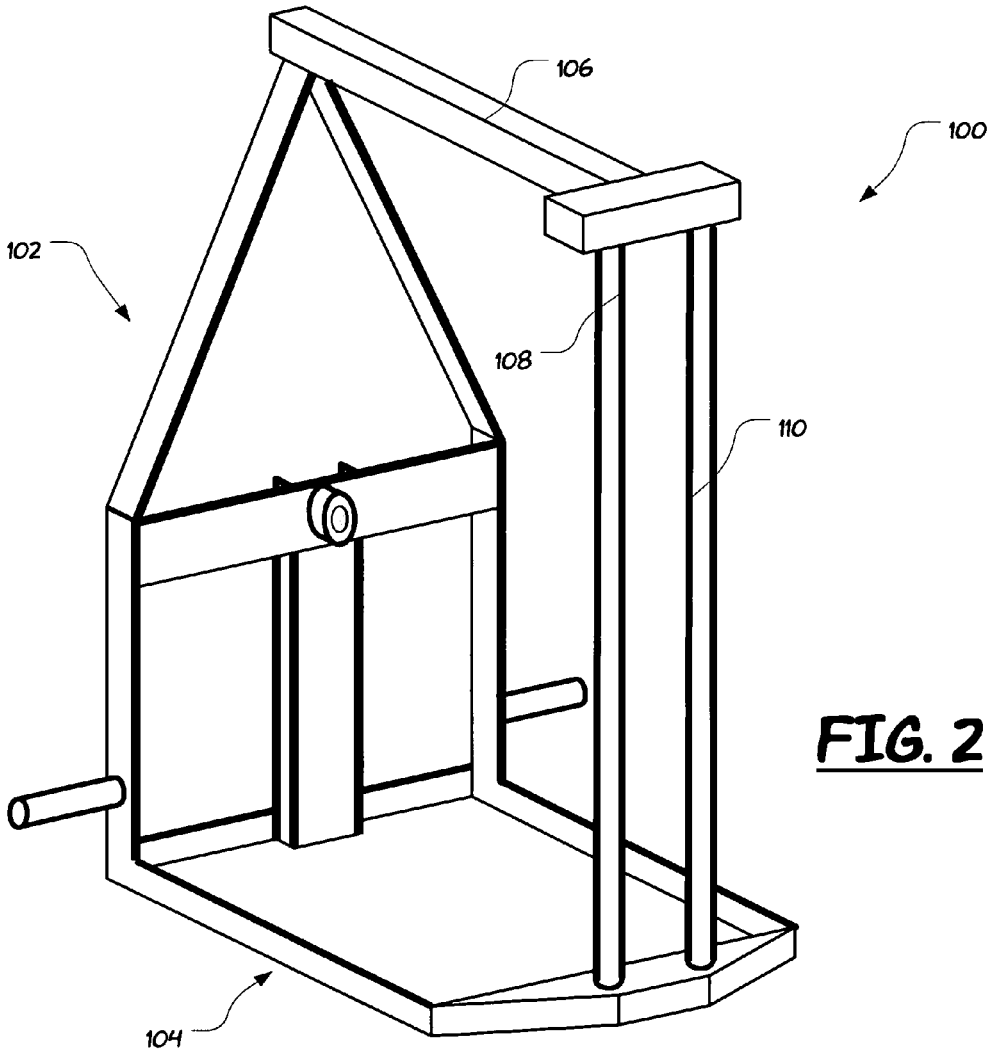
FIG. 2 is a diagram depicting further details of the frame 100.

FIG. 2 is a diagram depicting further details of the frame 100. The frame 100 includes a frame back 102, a base 104, a top member 106, a fence guide 108 and a vertical axle 110.

The frame back 102 is connected to base 104 and is aligned substantially perpendicular to the base 104. The top member 106 is connected to the top of frame back 102. The top member 106 is substantially parallel to the frame base 104 and substantially perpendicular to the frame back 102. Vertical axle 110 extends between the base 104 and the top member 106. Fence guide 108 also extends between the base 104 and a top member 106. Both the vertical axle 110 and the fence guide 108 are aligned substantially parallel to each other.

Figure 3B:
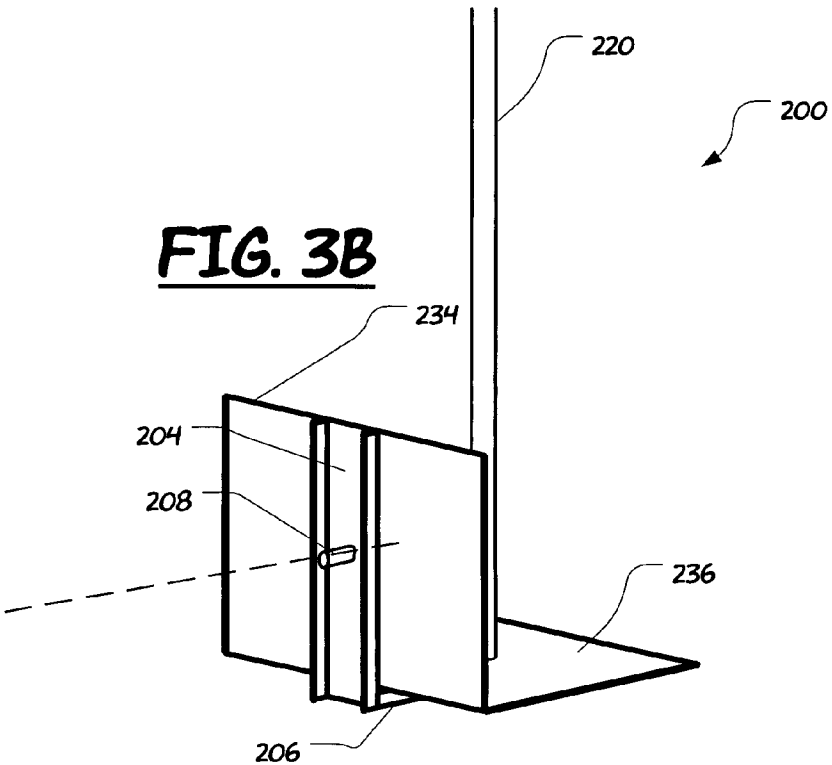
FIG. 3A and FIG. 3B are diagrams depicting embodiments of cradle 200.
Figure 3A:
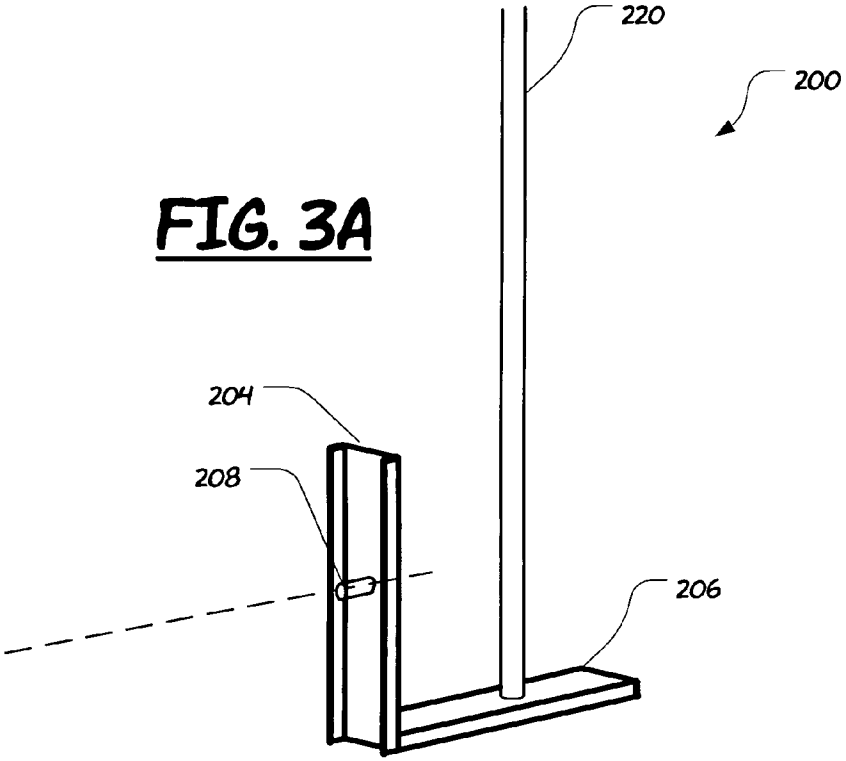

FIG. 3A and FIG. 3B are diagrams depicting embodiments of cradle 200. With reference to FIG. 3A, the cradle 200 includes a cradle back 204, a cradle base 206 and a spindle 220. The cradle base 206 is attached to the cradle back 204 and is aligned substantially perpendicular to the cradle back 204. Spindle 220 is connected to the cradle base 206 and extends upward and substantially parallel to the cradle back 204.

A cradle axle 208 is attached to the cradle back 204 and extends backward away from the spindle 220. The cradle axle 208 is aligned substantially perpendicular to the spindle 220. The cradle axle 208 is configured to allow the cradle 200 to be attached to the frame 100 (see FIG. 1A). In a preferred embodiment, the cradle 200 is rotatably attached to the frame 100. Further, the cradle 200 is configured to provide a counter balance that acts to place the cradle 200 in an "upright" position—wherein the spindle 220 is substantially vertical. The counter balance may be provided by configuring the cradle 200 so that cradle base 206 is a predetermined distance below the cradle axle 208 when the cradle 200 is attached to the frame back 102. The counter balance is preferably great enough to keep the cradle vertical and stable even when the cradle 200 is fully loaded with multiple spools of fence wire.

FIG. 3B depicts a further embodiment of cradle 200. In this embodiment a back plate 234 is attached to the cradle back 204 and a base plate 236 is attached to the cradle base 206. The back plate 234 may be configured to provide a barrier between the back frame 102 and the cradle 200 that can minimize potential pinch points.

Figure 4B:
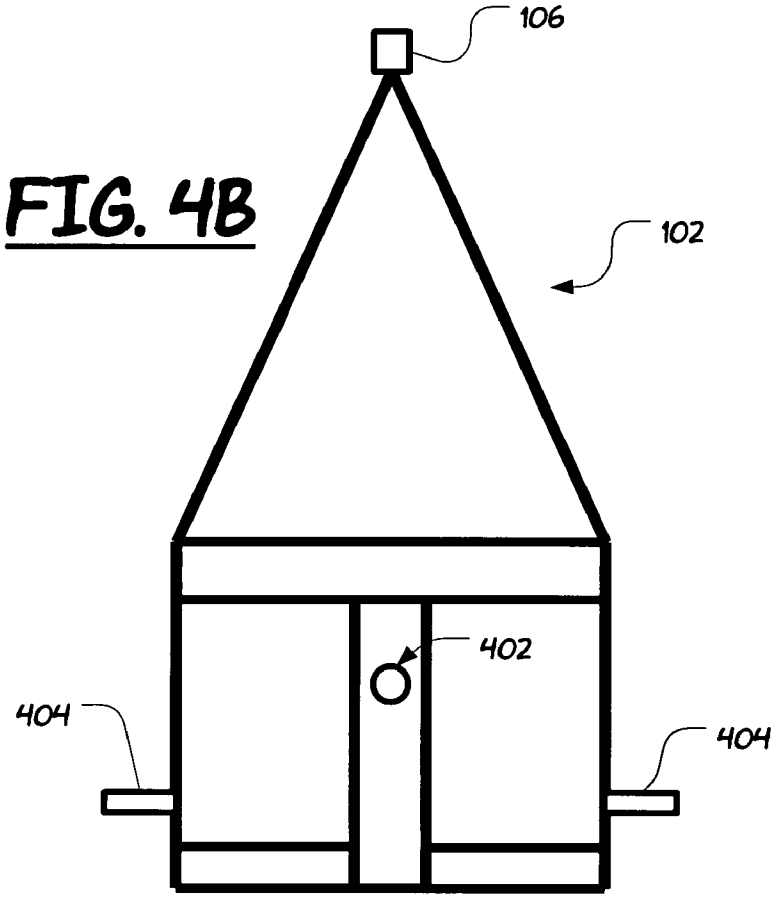
FIG. 4A through FIG. 4D are diagrams depicting further details of an embodiment of frame back 102 of frame 100.
Figure 4A:
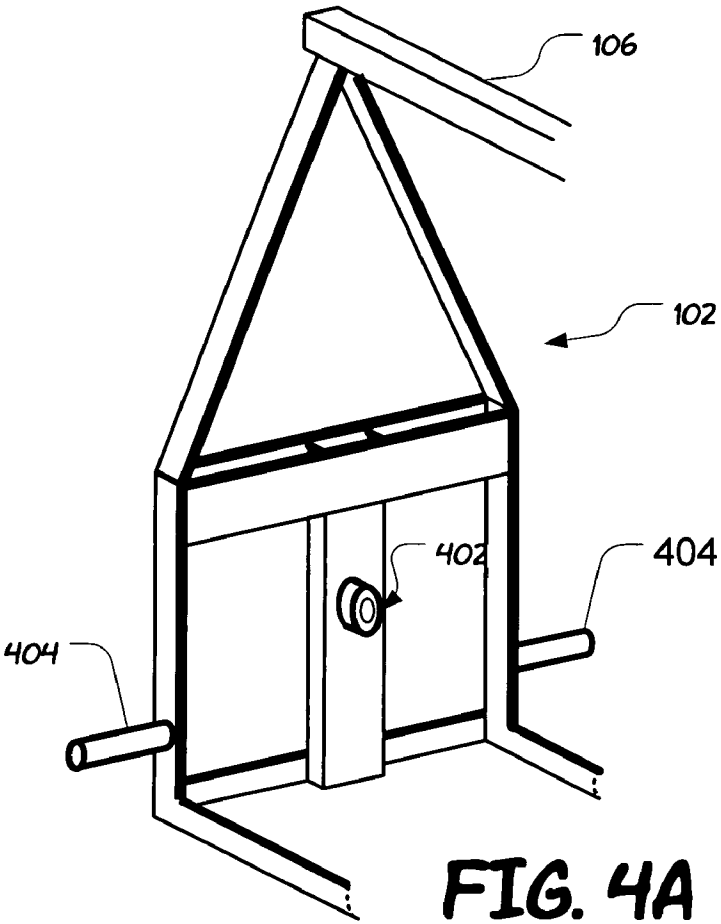
Figure 4D:
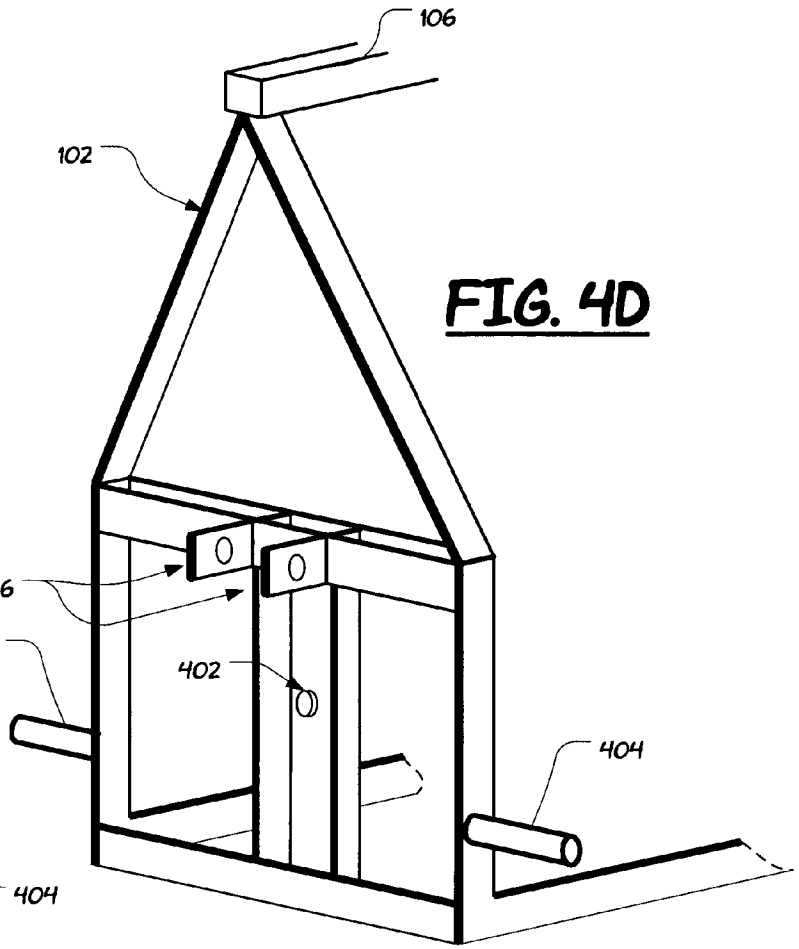
Figure 4C:
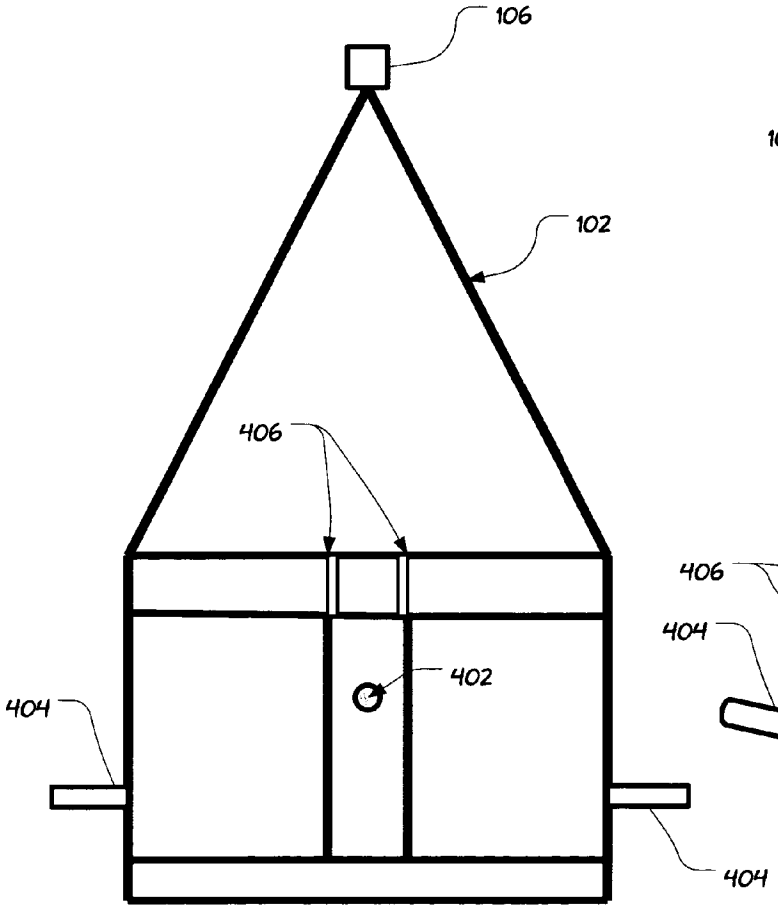

FIG. 4A through FIG. 4D are diagrams depicting further details of an embodiment of frame back 102. FIG. 4A and FIG. 4B are diagrams depicting a view of the frame back 102 from the interior of frame 100, adjacent the cradle 200. FIG. 4C and FIG. 4D are diagrams depicting the exterior side of the frame back 102. With reference to FIGS. 4A and 4B, it can be seen that a cradle mount 402 is provided on the frame back 102. The cradle mount 402 is configured to receive the cradle axle 208 of cradle 200 (see FIG. 3A and FIG. 3B). Further, in a preferred embodiment, the cradle mount 402 is configured to allow the cradle axle to be rotatable within the cradle mount 402.

The frame back 102 is configured to provide a means for attaching the fence spooling device 50 to a motorized vehicle, such as, for example, a tractor or other all terrain vehicle. In this embodiment, the means for connecting the fence spooling device 50 is a system for connecting to a typical tractor and includes grip pins 404 and center mount 406.

The grip pins 404 are attached to each side of the frame back 102, preferably near the bottom. A center mount 406 is provided on the back side of the back frame 102 (see FIG. 4C and FIG. 4D).

Figure 5A:
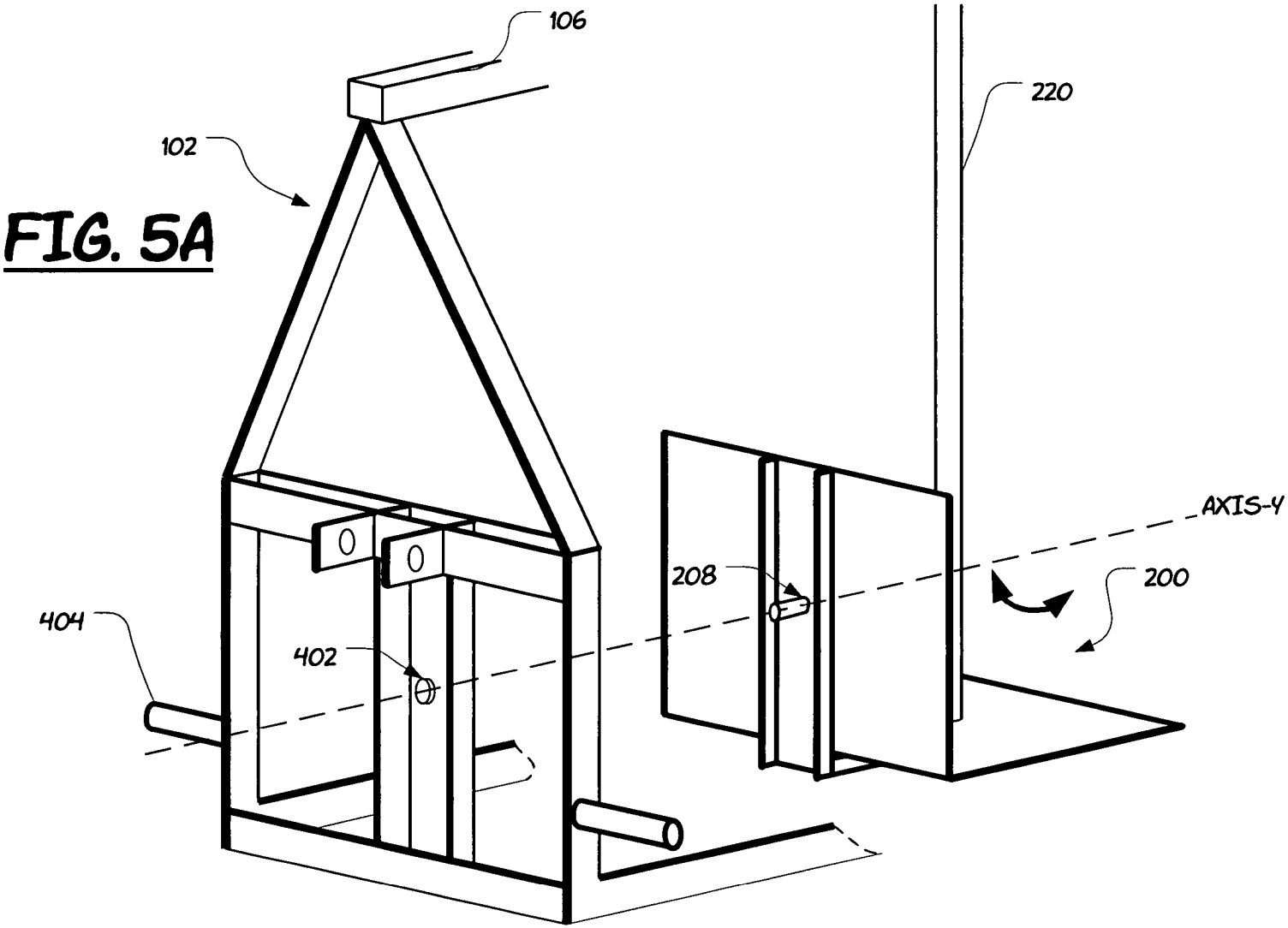
FIG. 5A and FIG. 5B are diagrams illustrating the interconnection between frame 100 and cradle 200.
Figure 5B:
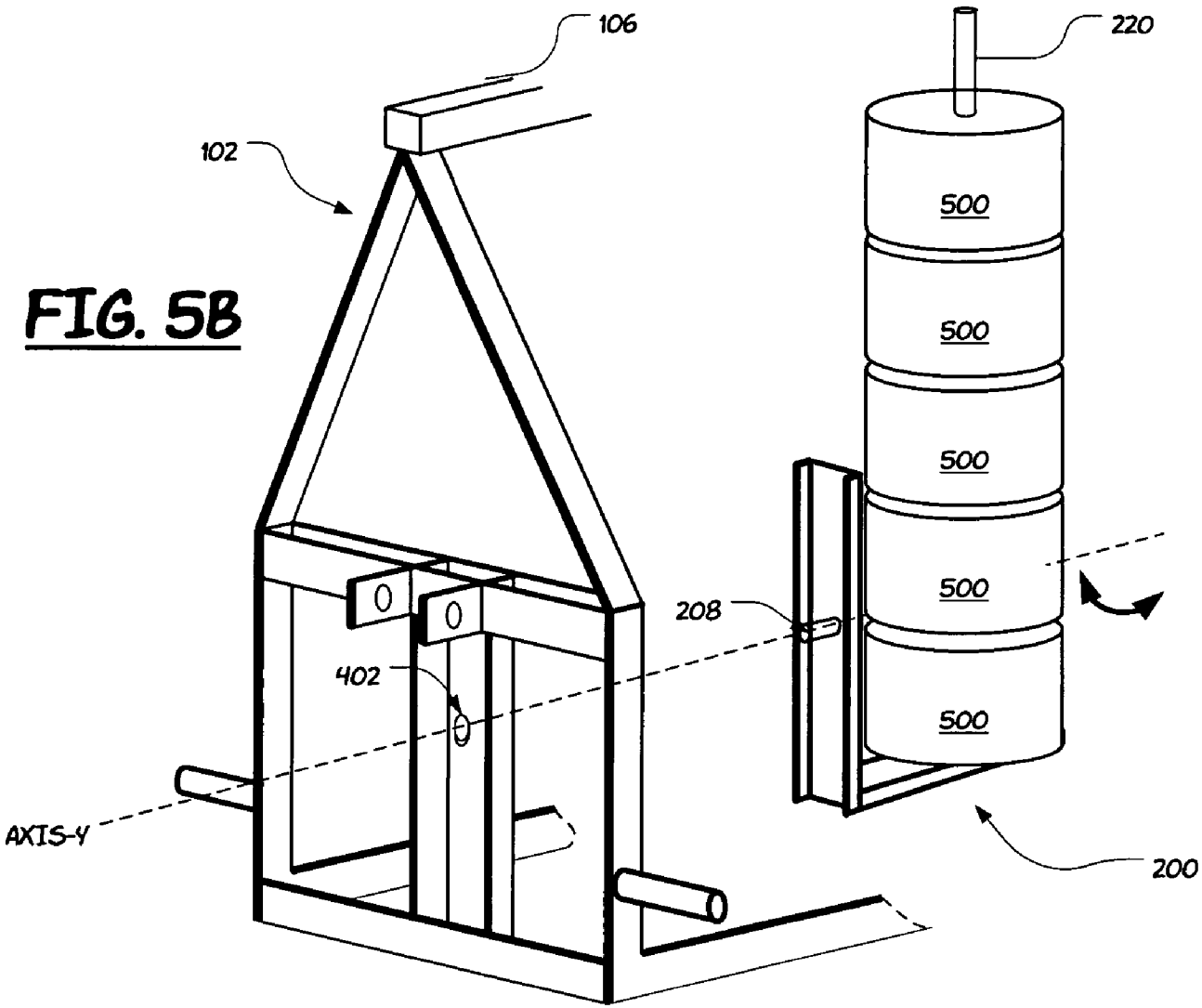

FIG. 5A and FIG. 5B are diagrams illustrating the interconnection between frame 100 and cradle 200. With reference to these diagrams, it can be seen that the cradle 200 attaches to the frame back 102 via cradle axle 208. The cradle axle 208 is received by the cradle mount 402 that is attached to back frame 102 (see FIGS. 4A and 4B). The cradle 200 is. rotatable about the axis (AXIS-Y) defined by the cradle axle 208 when attached to the back frame 102 via cradle mount 402. FIG. 5B depicts the cradle 200 loaded with several spools 500 of fencing wire. In this embodiment, each spool 500 is stacked one on top of the other along the common axis of the spindle 220.

Figure 6A:
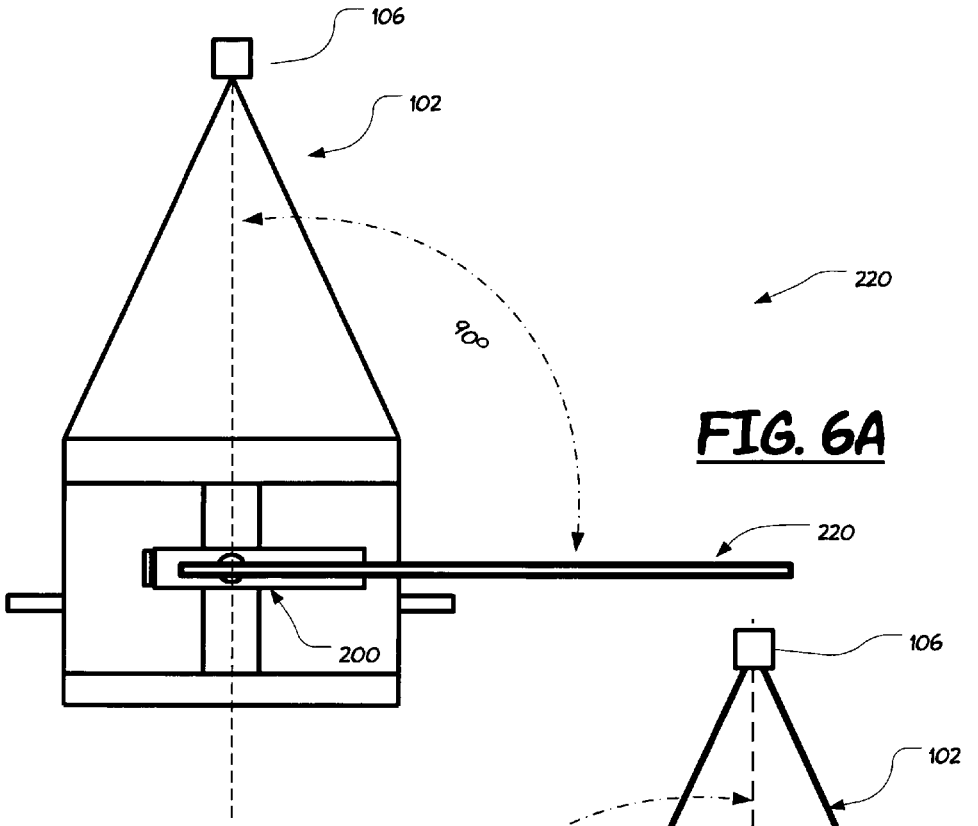
FIG. 6A and FIG. 6B are diagrams describing the rotational ability of the cradle 200 when attached to the frame 100.
Figure 6B:
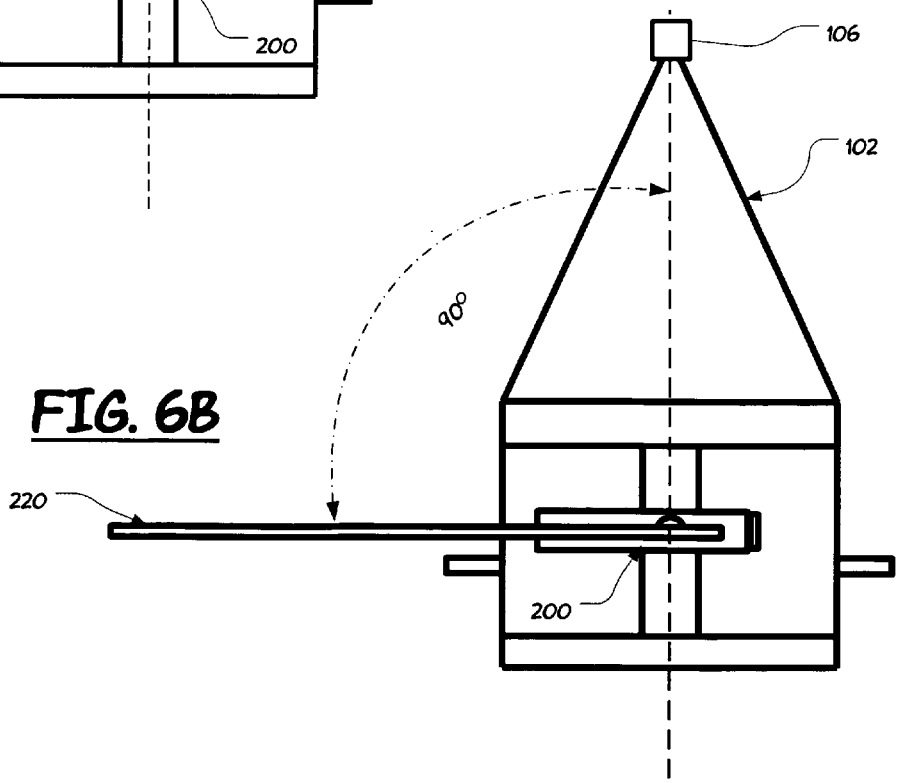

FIG. 6A and FIG. 6B are diagrams describing the rotational ability of the cradle 200 when attached to the frame 100. In a preferred embodiment, the cradle 200 is configured to be rotatable at least 90° from vertical, in both the left and right directions, to allow for easy loading/unloading of wire spools 500 (not shown) onto/off of the spindle 220. The cradle 200 is preferably configured so that it provides counterbalance that allows it to naturally move/rotate into a position where spindle 220 is substantially vertical, whether loaded with spools 500 or not.

FIG. 7A-FIG. 7D are diagrams depicting an embodiment of gripper assembly 300. The gripper assembly 300 is configured to allow the operator of the vehicle/tractor on which the fence spooler 50 is mounted, to grip the fence wire so that it does not continue to be spooled off of the spool 500. Further, the gripper assembly 300 is configured to allow the operator of the tractor to engage/dis-engage the gripper assembly from the tractor cab, without having to leave the tractor cab or otherwise get off of the tractor.

Figure 7A:
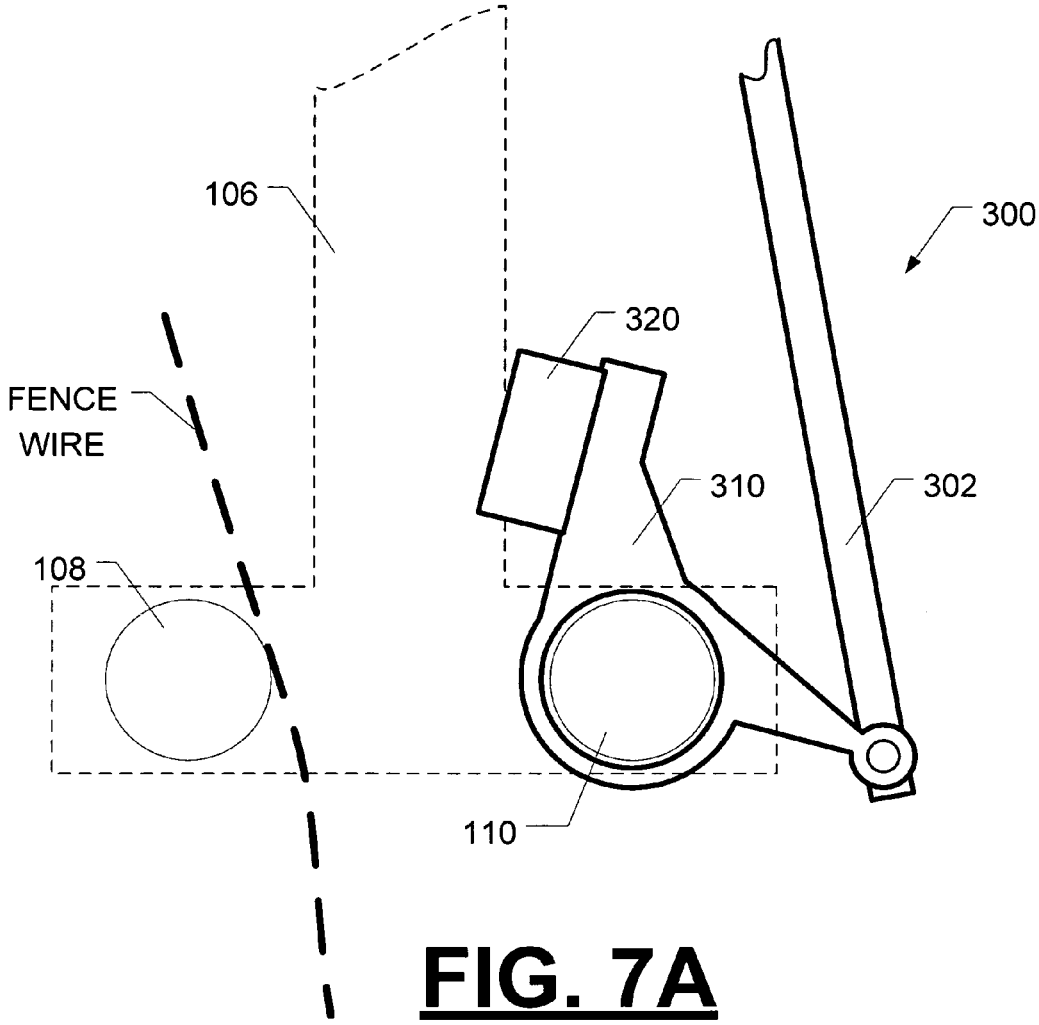
FIG. 7A-FIG. 7D are diagrams depicting an embodiment of gripper assembly 300.

FIG. 7A is a top view depiction of the gripper assembly 300 attached to the frame 100. The gripper assembly 300 includes a gripper frame 310 that is configured to rotate about a vertical axle 110. A gripper shoe 320 is attached to the gripper frame 310. A control rod 302 is attached to the gripper frame 310. The control rod 302 is connected to a handle 360 and is configured to cause the gripper frame 310 to rotate about the vertical axle 110 when activated.

Figure 7B:
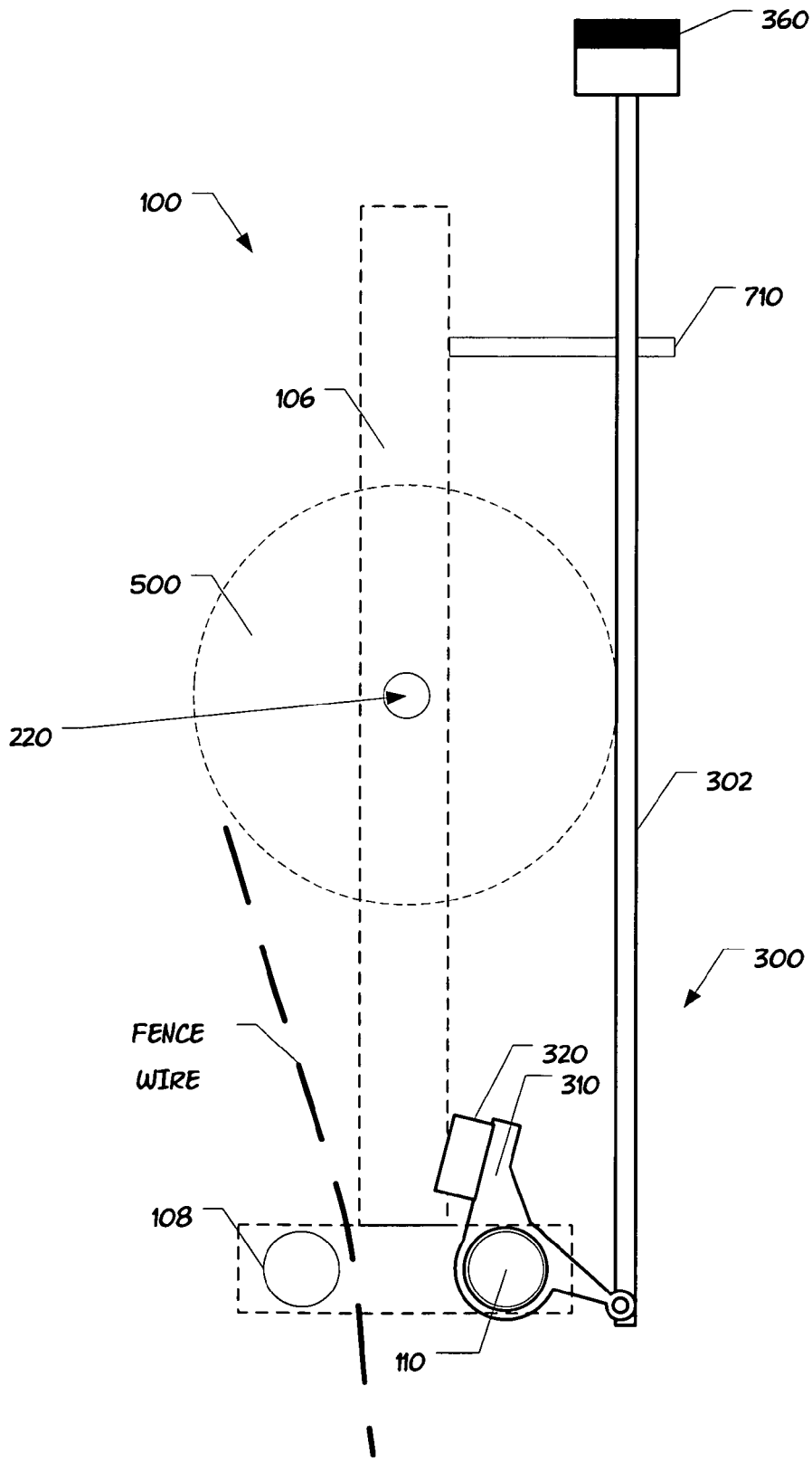

FIG. 7B is a further top view depicting the gripper assembly 300 attached to the frame 100. In this view it can be seen that fence wire is fed from a spool 500 mounted on the spindle 220 of cradle 200. The fence wire is threaded between the fence guide 108 and the vertical axle 110. The fence wire is then attached to a fence post 65 (FIG. 1B) and the fence spooling device 50 is moved forward along the perimeter defined by one or more fence post 65 (FIG. 1B). As the fence spooling device 50 moves forward along the perimeter defined by one or more fence posts 65 (FIG. 1B), fence wire is spooled off of the spool 500 mounted on cradle 200. The gripper shoe 320 is out of the way of the fence wire path and does nothing to hinder or otherwise resist the flow of fence wire from the spool 500. Support arm 710 is provided to support the control rod 302 in a desired position.

Once a predetermined amount of fence wire is distributed, it must be attached to the fence post 65 (FIG. 1B), often via tacks, staples, straps, wire bands or the like. It is typically desirable that the fence wire be tensioned a desired amount to allow for the fence wire to be placed substantially parallel to the ground along the fence posts 65 (FIG. 1B). To allow a means to put the fence wire under tension so that the fence wire may be drawn to a desired level of tautness and then be attached to the fence post 65 (FIG. 1B), the present invention provides the gripper assembly 300.

Figure 7C:
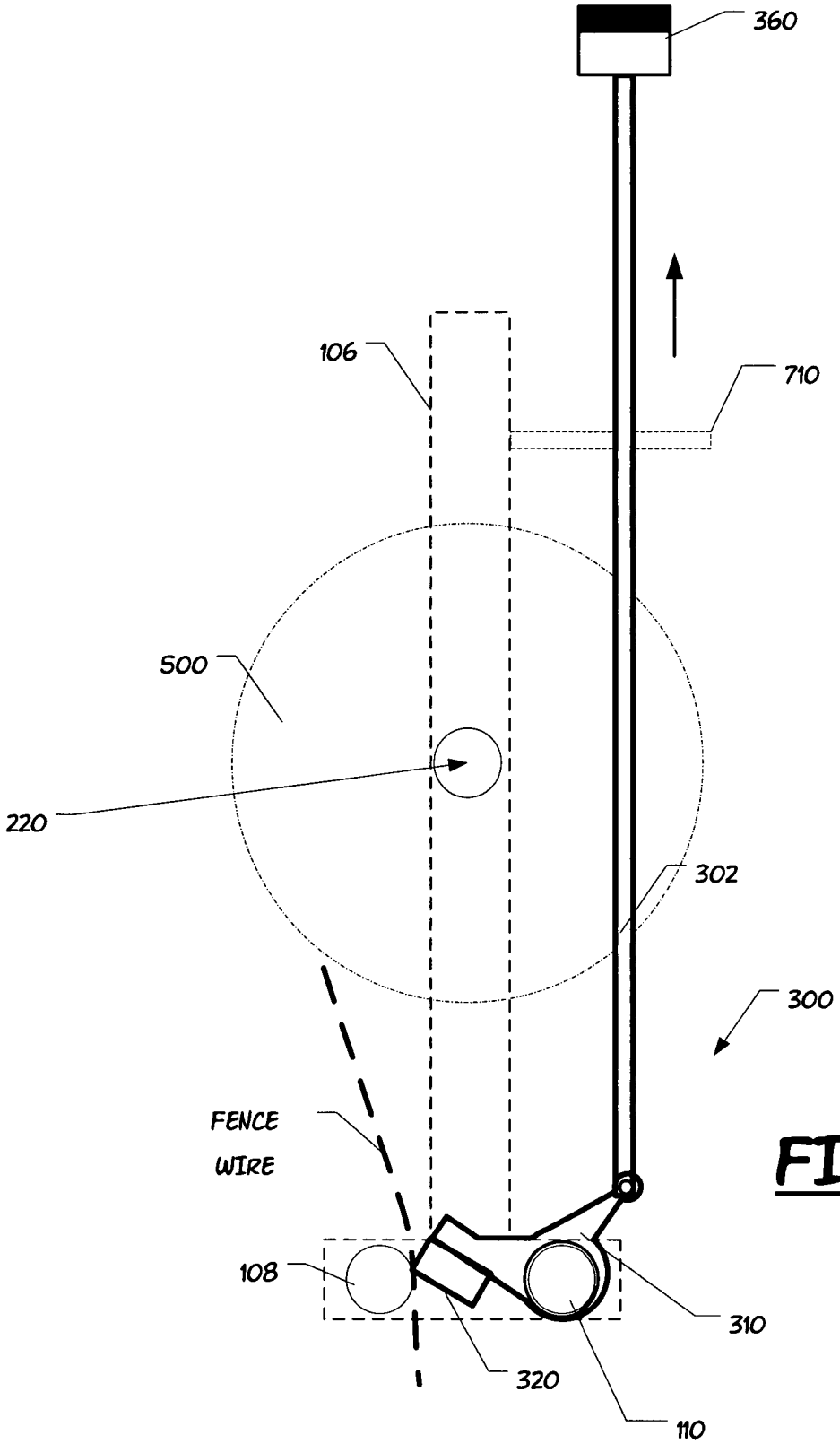

With reference to FIG. 7C, to engage gripper assembly 300, the operator of the tractor/fence spooling device 50 merely pulls the handle 360 of the gripper assembly 300 forward toward the tractor cab (NOT SHOWN) (in the direction of the arrow). The handle 360 is attached to the control rod 302 which, in turn, is connected to the gripper frame 310. As the handle 360 is pulled forward, the gripper frame 310 is rotated about the vertical axle 110. As the gripper frame 310 rotates about the vertical axle, the gripper shoe 320 is moved onto the fence wire (spooled from the spool 500) and pushes the fence wire against the fence guide 108, thereby providing resistance to movement of the fence wire. The operator may then move the tractor (NOT SHOWN) forward and thereby place a desired level of tension on the fence wire to bring the wire to a desired level of tautness.

The gripper assembly 300 is preferably configured so that the handle 360 is accessible by the operator of, for example, a tractor supporting the spooling device 50, from the operators' cab of the tractor. In this way, it is possible for a tractor operator to maintain control of fence distribution and bring distributed fence wire to a desired level of tautness, without requiring the operator to exit the operators' cab of the tractor.

Figure 7D:
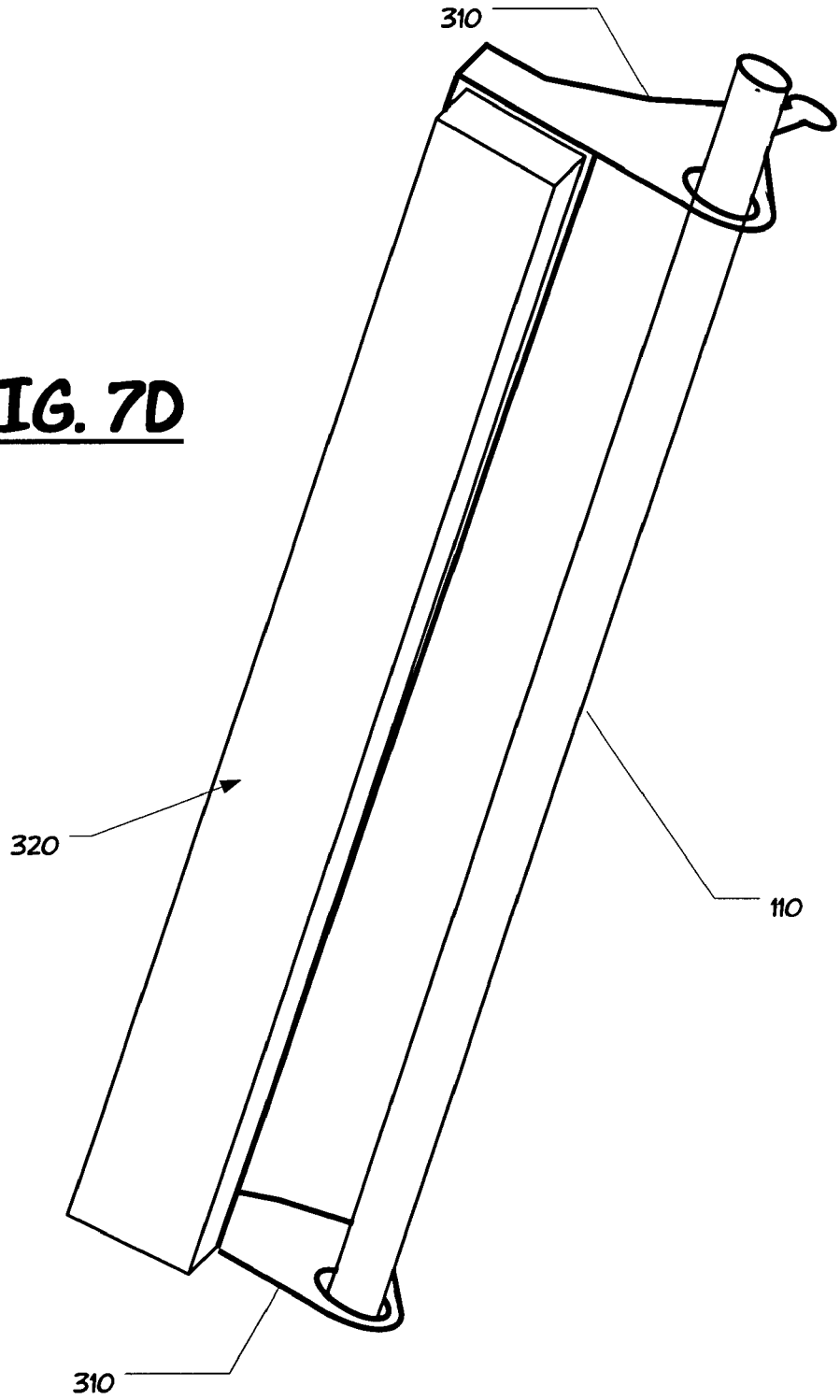

FIG. 7D is a diagram depicting further details of gripper frame 310. The gripper shoe 320 is attached to the gripper frame 310 and extends along substantially all of the length of gripper frame 310. In one embodiment the gripper shoe is made of wood and may be detached from the gripper frame 310 when it wears out. It will be recognized that the gripper shoe may also be made of other materials and may or may not extend the full length of the gripper frame 310.

Figure 8A:
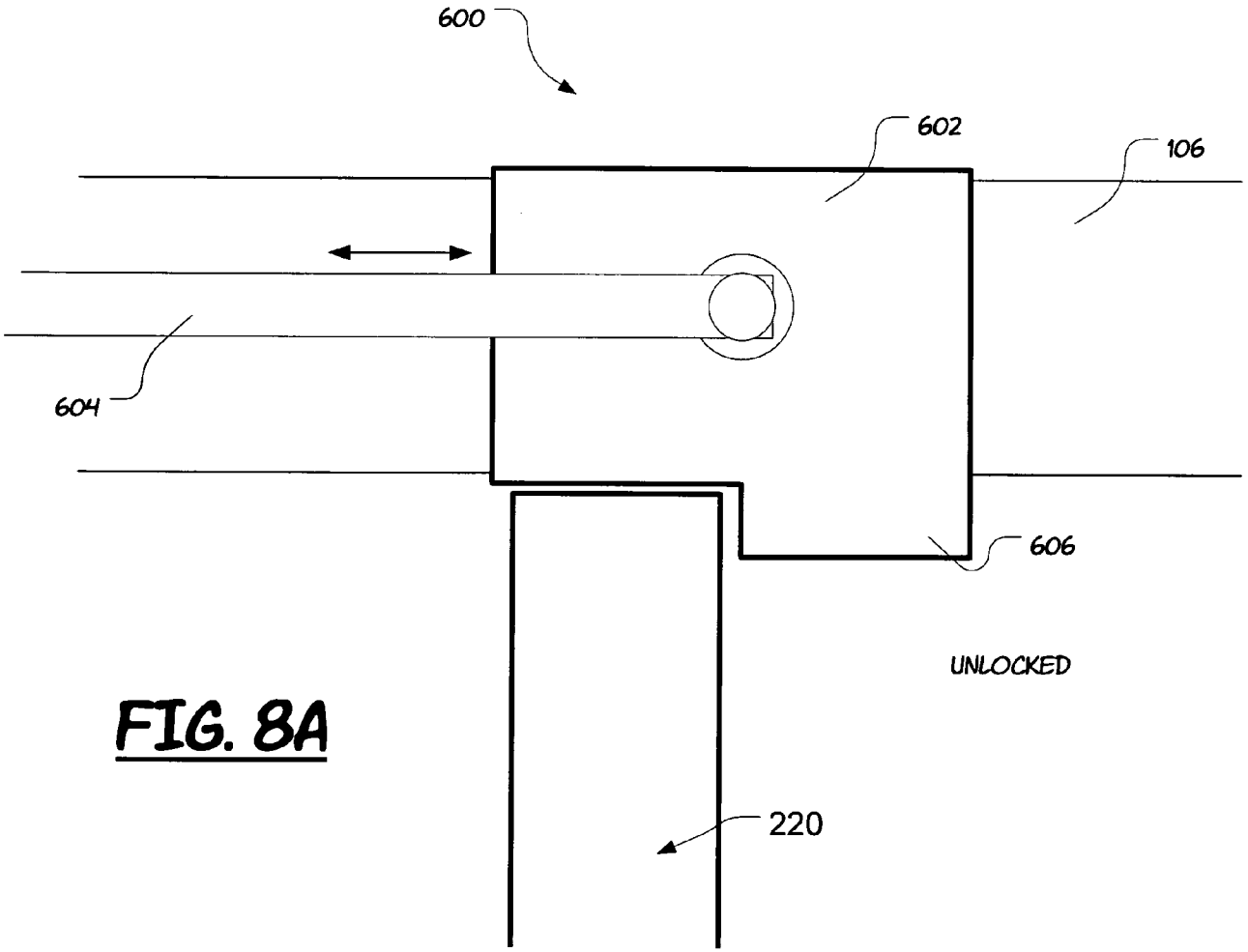
FIG. 8A-FIG. 8D are diagrams depicting details of an embodiment of cradle lock 600.
Figure 8B:
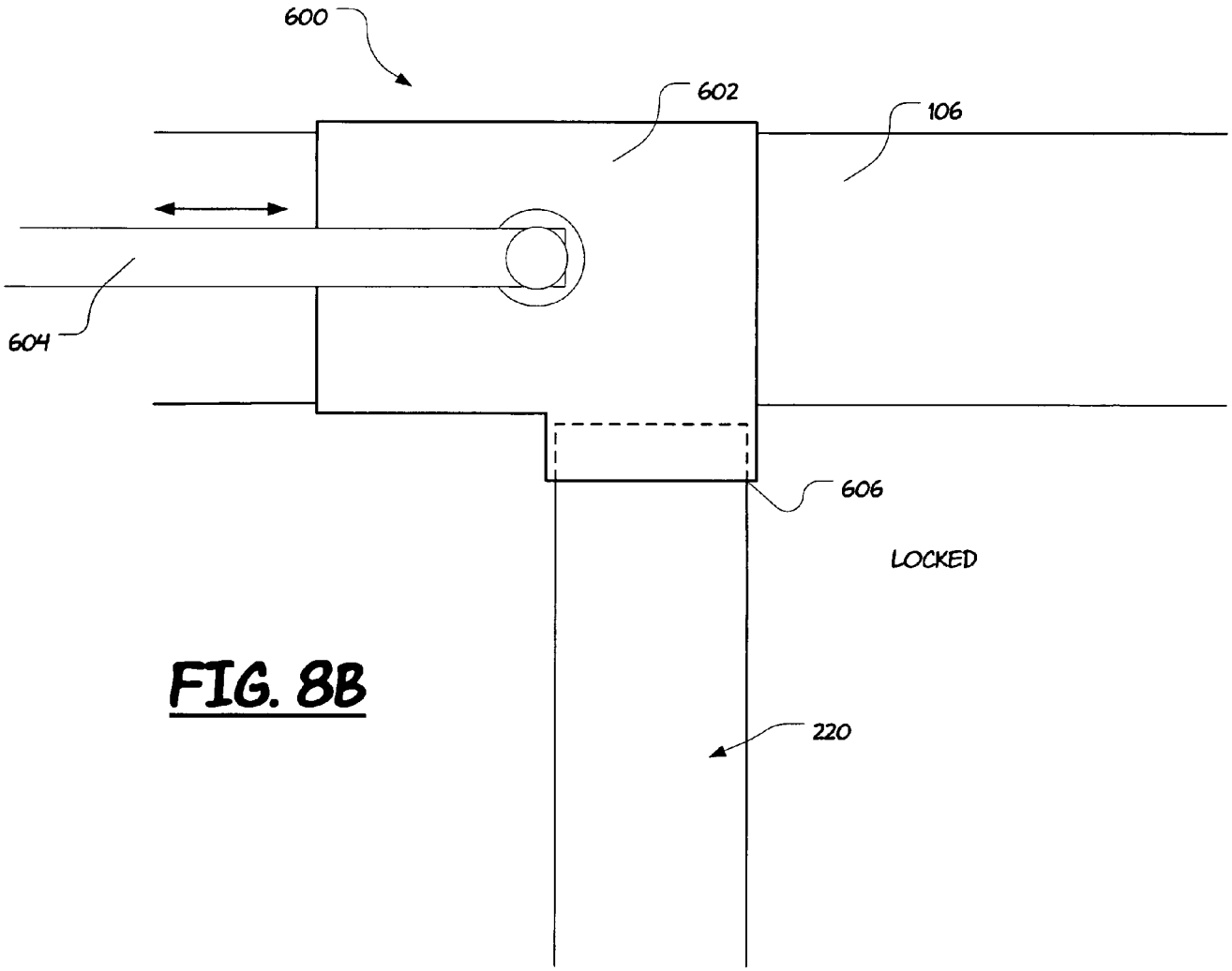

FIG. 8A-FIG. 8D are diagrams depicting details of an embodiment of cradle lock 600. In FIG. 8A it can be seen that the cradle lock 600 includes lock sleeve 602 and actuator arm 604. The sleeve 602 is configured to include a retainer 606.

The lock sleeve 602 is configured to contain movement of the spindle 220 (and thus the movement of the cradle 200) when the lock sleeve 602 is placed in a "locked" position (FIG. 8B) and to allow movement of the spindle 220 when the lock sleeve 602 is placed in a "unlocked" position (FIG. 8A).

In one embodiment the lock sleeve is configured to fit around the top support 106 and be at least partially movable along the top support 106 as indicated by the arrows. The actuator arm 604 is attached to the lock sleeve 602 at one end and a handle (not shown) on the other end. By pulling or pushing the handle (not shown) the actuator arm 604 is moved fore or aft along the upper support 106 and thereby cause the retainer 606 to move around the spindle 220 or away from the spindle 220. When the retainer 606 is moved around the spindle 220, the spindle 220 is stopped from rotating to the left or right of the top support 106. In this way the cradle 200 (not shown) is held in place and wire spools secure on the spindle 220.

Figure 8C:
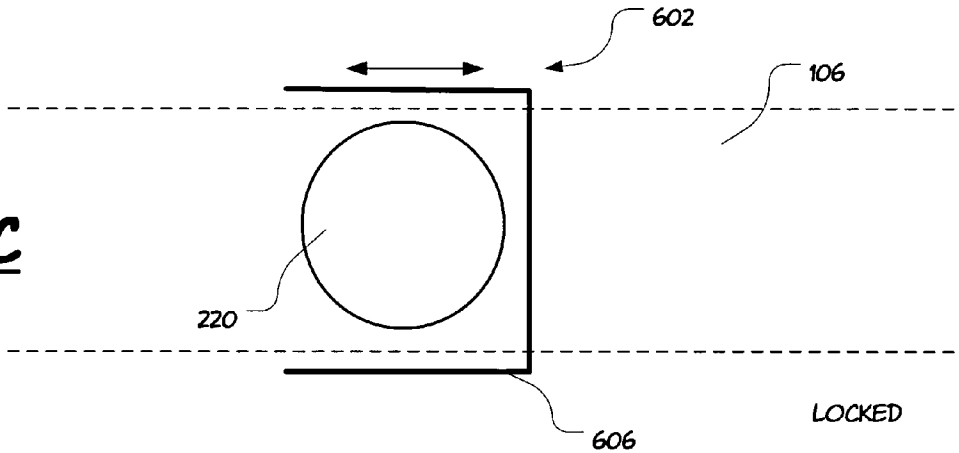
Figure 8D:
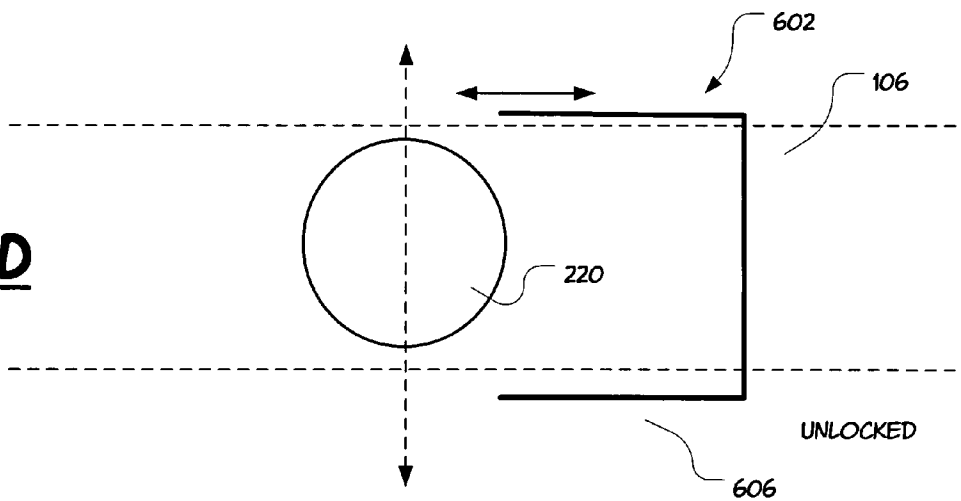

FIG. 8C and FIG. 8D are diagrams depicting a top down view of the lock sleeve 602 and retainer 606 in relation to the cradle spindle 220 when the lock assembly is "locked" (FIG. 8C) and "Unlocked" (FIG. 8D).

Figure 9A:
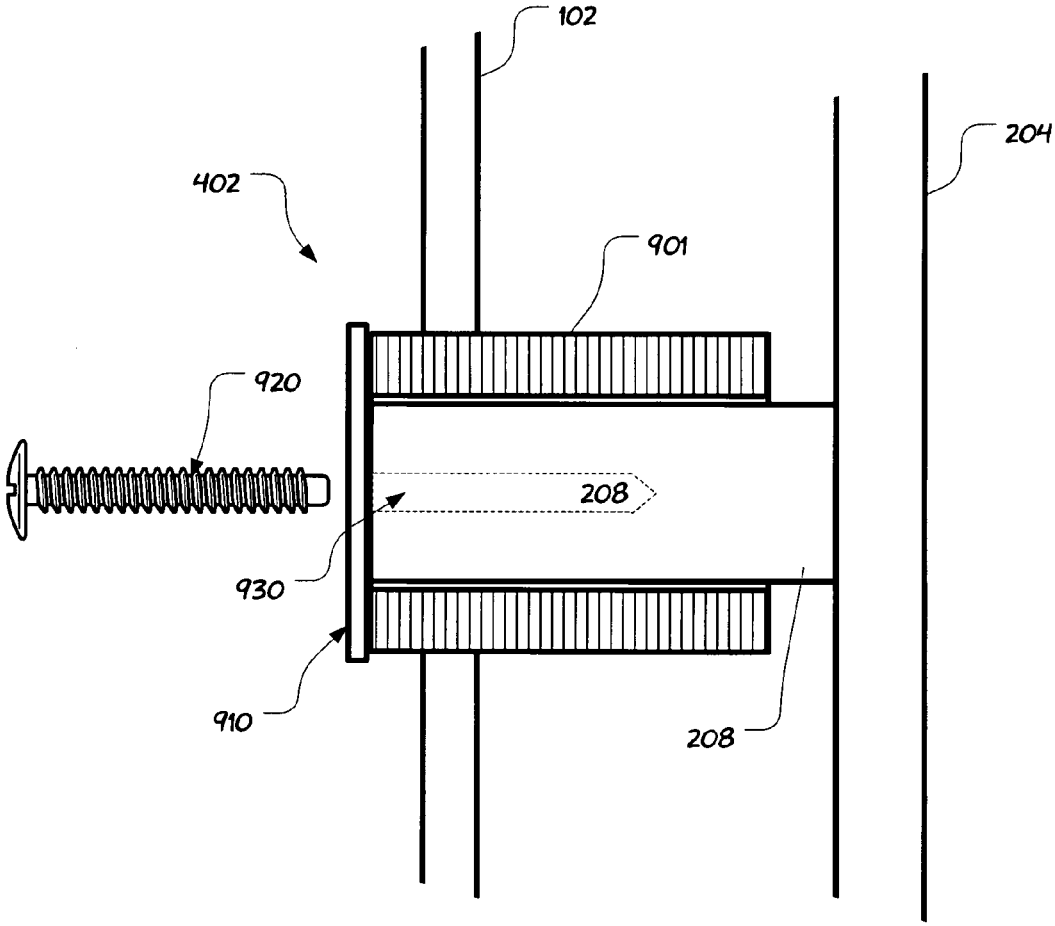
FIG. 9A and FIG. 9B are diagrams depicting details of cradle mount 402.
Figure 9B:
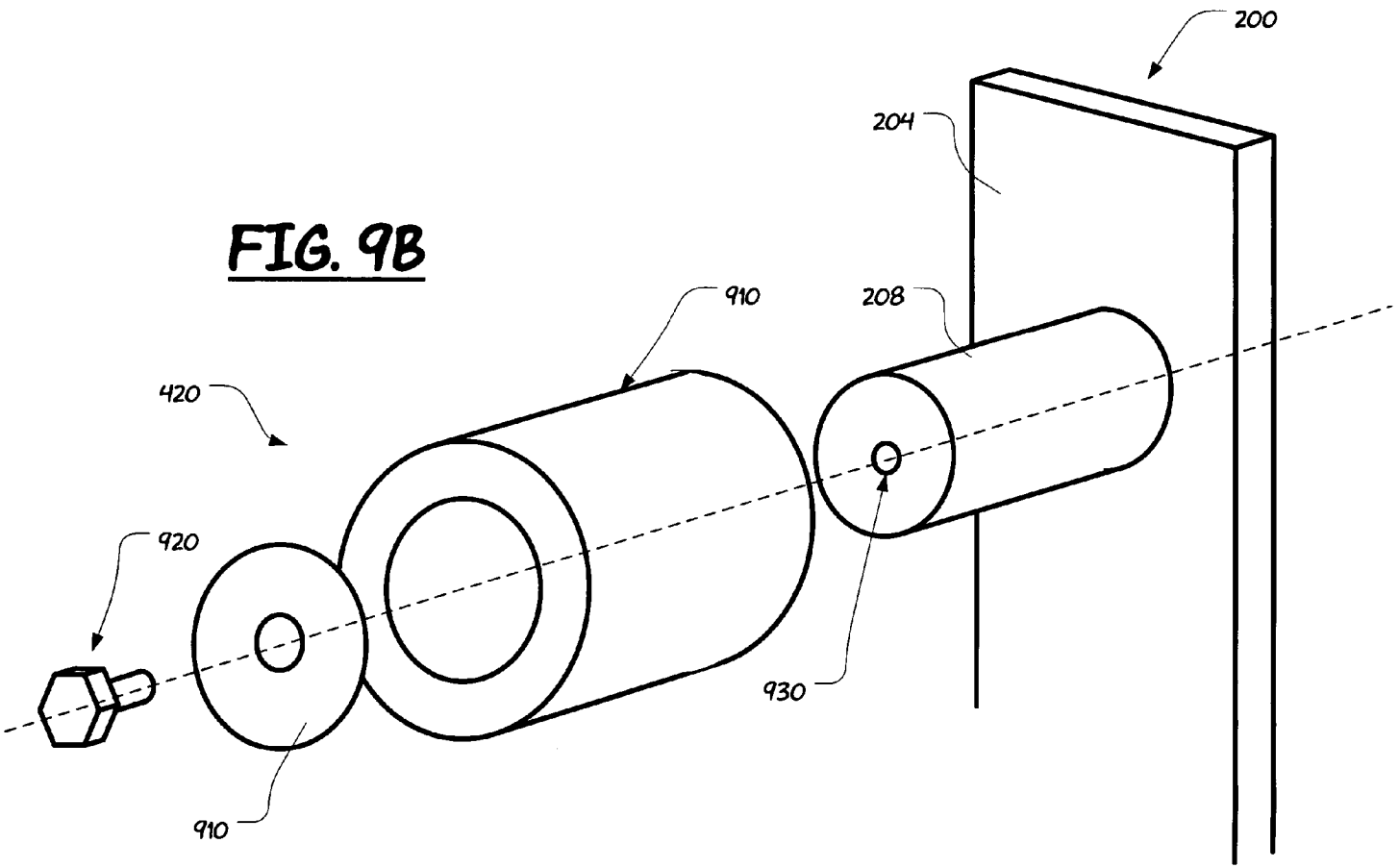

FIG. 9A and FIG. 9B are diagrams depicting details of cradle mount 402. In one embodiment, the cradle mount 402 is configured as cylindrical sleeve 901 for receiving the cradle axle 208. The sleeve 901 is configured to allow the axle 208 to freely rotate within the sleeve. A retainer 910 is provided and is configured to have a diameter or width/length that is greater than the interior diameter of the cylindrical sleeve 901.

Once the cradle axle 208 is placed into the cylindrical sleeve 901, a retainer 910 may be attached to the end of the cradle axle 208 to preclude its removal from the cylindrical sleeve 901. The retainer 901 may be a washer or plate that may be attached to the cradle axle 208 via, for example, welding or bolting the retainer onto the end of cradle axle 208.

In a one embodiment, the retainer 901 is attached to cradle axle 208 via a bolt 920. The bolt 920 is threaded into the end of the cradle axle 208. Alternatively, the retainer 901 may be a retainer pin such as, for example, a cotter pin that runs thru an opening (not shown) in the end of the cradle axle 208. Once placed thru the opening, the cotter pin is aligned substantially perpendicular to the length of the cradle axle 208. In a preferred embodiment, the cradle axle 208 is tapped 930 to receive a screw or bolt 920.

Figure 10B:
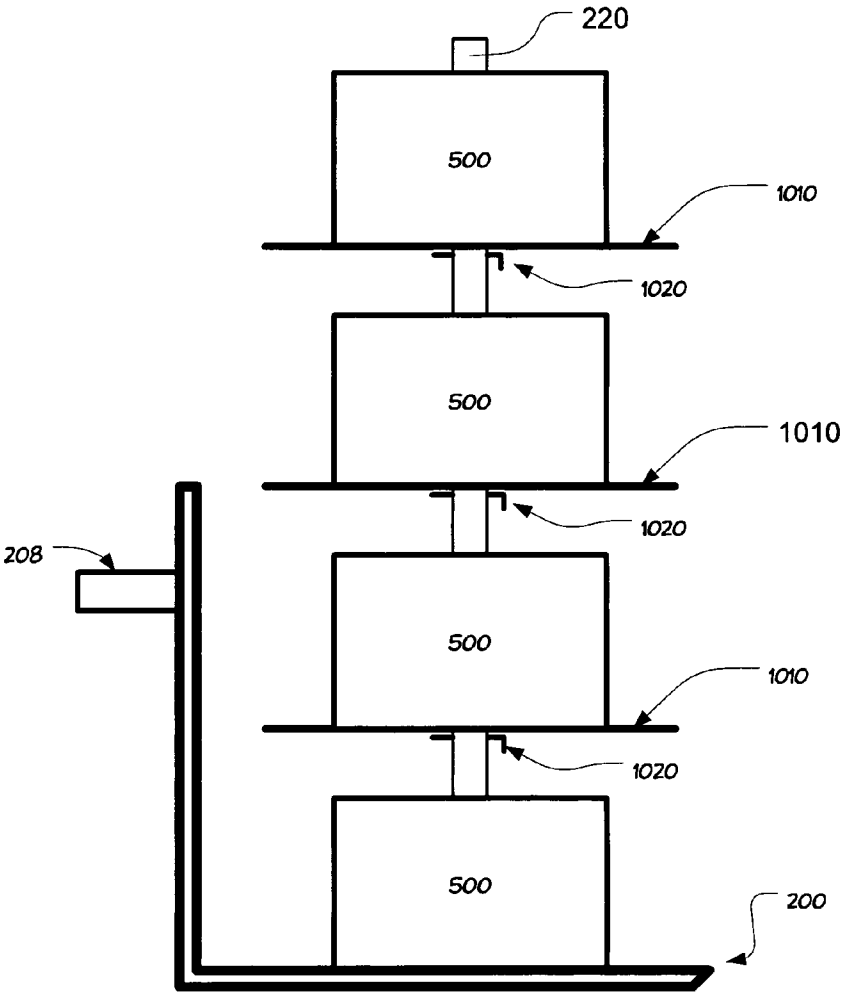
FIG. 10A and FIG. 10B are diagrams depicting an embodiment of cradle 200 configured to accommodate spool separators 1010.
Figure 10A:
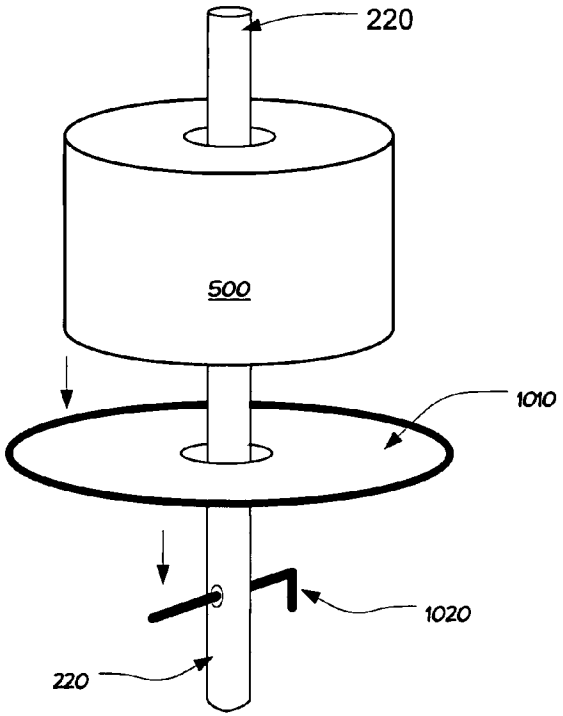

FIG. 10A and FIG. 10B are diagrams depicting an alternate embodiment of the invention in which separator plates 1010 are provided to maintain a predetermined spacing between multiple spools 500 that may be placed onto the spindle 220. By using the separator plates 1010 it is possible to insure that each spool 500 can rotate independently of each other, without any frictional influence from adjacent spools that may be in contact with a given spool. To keep a desired spacing, the spindle 220 may be configured to receive plate retainers 1020. The plate retainers 1020 may be received in openings thru the spindle 220. The plate retainers 1020 may be removable pins or rods configured to extend thru the diameter of the spindle 220 and provide enough length on each side of the spindle 220 to support a separator plate 1010 on top thereof.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed:

1. A fence spooling device comprising:
frame configured to be attached to a motor vehicle;
cradle pivotally connected to the frame and configured to receive a spool of wire;
gripper assembly configured to selectively apply resistance to the flow of fence wire spooled from a spool loaded onto the cradle;
gripper assembly comprises:
a gripper shoe, a vertical axle and a gripper frame;
the gripper frame is configured to rotate about the vertical axle;
control rod is connected to the gripper frame and a handle;
the control rod is configured to extend the handle into the operator control area of the motor vehicle and into reach of an operator of the motor vehicle located within the operator control area of the motor vehicle when the frame is attached to the motor vehicle; and
the gripper frame is configured to rotate about the vertical axle and place the gripper shoe into contact with the spool of wire when manual force is placed on the handle by the operator of the motor vehicle.

2. The device of claim 1 further comprising cradle lock assembly for holding the cradle in a predetermined position.

3. The device of claim 1, wherein the cradle comprises:
base;
spindle connected to the base and aligned substantially perpendicular to the base;
back connected to the base and aligned substantially parallel to the spindle; and cradle axle connected to the back and extending away from and substantially parallel to the base.

4. The device of claim 3, wherein the frame comprises
frame back;
frame base connected to the frame back,
vertical axle connected to the frame base;
wire guide connected to the frame base; and
the vertical axle is aligned substantially parallel to the wire guide.

5. The device of claim 4 wherein the frame back comprises a cradle mount configured to receive the cradle axle.

6. The device of claim 5 wherein the cradle mount is configured to allow the cradle axle to rotate within a plane that is substantially perpendicular to the plane in which the frame back extends.

7. The device of claim 6 wherein the cradle is configured so that the cradle base extends along a plane that is a predetermined distance below the plane in which the cradle axle extends.

8. The device of claim 5 wherein the cradle mount comprises a cylindrical sleeve configured to receive the cradle axle.

9. The device of claim 1 wherein the motor vehicle comprises a tractor.

10. A fence spooling device comprising:

frame configured to be attached to a motor vehicle;

cradle configured to receive a spool of fence wire and rotatable about a predetermined axis relative to the frame;

gripper assembly configured to selectively apply resistance to the flow of wire spooled from a spool loaded onto the cradle;

the gripper assembly comprises:

gripper shoe, a vertical axle and a gripper frame;

the gripper frame configured to rotate about the vertical axle;

control rod connected to the gripper frame and a handle;

the control rod is configured to extend the handle toward the operator control area of the motor vehicle so as to be within reach of an operator of the motor vehicle; and the gripper frame is configured to rotate about the vertical axle and place the gripper shoe into contact with the spool of wire when force is placed on the handle by the operator of the motor vehicle.

11. The device of claim 10 wherein the gripper assembly is selectively engageable by an operator from the motor vehicle operator cab.

12. The fence device of claim 10 further comprising cradle lock for selectively limiting movement of the cradle about the predetermined axis.

13. The fence device of claim 10 wherein said frame comprises a back frame and a cradle mount for attaching the cradle to the back frame.

* * * * *